US008371918B2

(12) United States Patent
Snow

(10) Patent No.: US 8,371,918 B2
(45) Date of Patent: Feb. 12, 2013

(54) SPECIAL MULTIPLIER BONUS GAME IN PAI GOW POKER VARIANT

(75) Inventor: Roger M. Snow, Las Vegas, NV (US)

(73) Assignee: SHFL Entertainment, Inc., Las Vegas, NV (US)

( * ) Notice: Subject to any disclaimer, the term of this patent is extended or adjusted under 35 U.S.C. 154(b) by 0 days.

(21) Appl. No.: 13/047,563

(22) Filed: Mar. 14, 2011

(65) Prior Publication Data

US 2011/0165928 A1 Jul. 7, 2011

Related U.S. Application Data

(63) Continuation of application No. 10/770,613, filed on Feb. 2, 2004, now Pat. No. 7,905,770.

(51) Int. Cl.
*A63F 9/24* (2006.01)

(52) U.S. Cl. ..... 463/13

(58) Field of Classification Search ..... 463/13
See application file for complete search history.

(56) References Cited

U.S. PATENT DOCUMENTS

| | | | |
|---|---|---|---|
| 3,595,987 | A | 7/1971 | Vlahos |
| 4,007,487 | A | 2/1977 | Vlahos |
| 4,100,569 | A | 7/1978 | Vlahos |
| 4,344,085 | A | 8/1982 | Vlahos |
| 4,397,509 | A | 8/1983 | Miller et al. |
| 4,614,342 | A | 9/1986 | Takashima |
| 4,743,022 | A | 5/1988 | Wood |
| 4,807,884 | A | 2/1989 | Breeding |
| 4,836,553 | A | 6/1989 | Suttle et al. |
| 4,861,041 | A | 8/1989 | Jones et al. |
| 4,948,134 | A | 8/1990 | Suttle et al. |
| 4,995,615 | A | 2/1991 | Cheng |
| 5,022,653 | A | 6/1991 | Suttle et al. |
| 5,046,736 | A | 9/1991 | Bridgeman et al. |
| 5,098,107 | A | 3/1992 | Boylan et al. |
| 5,159,549 | A | 10/1992 | Hallman, Jr. et al. |
| 5,174,579 | A | 12/1992 | Griffiths |
| 5,221,083 | A | 6/1993 | Dote |
| 5,248,142 | A | 9/1993 | Breeding |
| 5,255,915 | A | 10/1993 | Miller |
| 5,257,810 | A | 11/1993 | Schorr et al. |
| 5,265,877 | A | 11/1993 | Boylan et al. |
| 5,265,882 | A | 11/1993 | Malek |
| 5,275,411 | A | 1/1994 | Breeding |
| 5,275,415 | A | 1/1994 | Wisted |
| 5,275,416 | A | 1/1994 | Schorr et al. |
| 5,288,077 | A | 2/1994 | Jones |
| 5,288,081 | A | 2/1994 | Breeding |

(Continued)

OTHER PUBLICATIONS

"Over/Under 13 Blackjack," Product Brochure published by Gaming Concepts, Inc., 10 pages (1988).

*Primary Examiner* — Pierre E Elisca
(74) *Attorney, Agent, or Firm* — TraskBritt

(57) ABSTRACT

A method of playing a Pai Gow poker wagering card game is disclosed. The method includes the steps of: a player placing a wager on a Pai Gow poker game; players placing a second wager against a pay table on a separate poker-type game that uses each player's best five-card hands; dealing seven-card hands from a set of cards to six player positions and to one dealer position; resolving the Pai Gow game and awarding bonuses to players who made the second wager and that have a best five-card hand that exceeds a predetermined rank; and awarding an additional bonus to players with hands that exceed the predetermined rank if the dealer's best five-card hand is equal to or less than a predetermined rank. An optional envy hand event may be included with the second wager or a special qualifying second or third wager.

27 Claims, 1 Drawing Sheet

U.S. PATENT DOCUMENTS

| | | | |
|---|---|---|---|
| 5,294,128 | A | 3/1994 | Marquez |
| 5,308,065 | A | 5/1994 | Bridgeman et al. |
| 5,324,041 | A | 6/1994 | Boylan et al. |
| 5,332,228 | A | 7/1994 | Schultz |
| 5,356,140 | A | 10/1994 | Dabrowski et al. |
| 5,364,105 | A | 11/1994 | Jones |
| 5,366,228 | A | 11/1994 | Kangsanaraks |
| 5,377,973 | A | 1/1995 | Jones et al. |
| 5,377,993 | A | 1/1995 | Josephs |
| 5,377,994 | A | 1/1995 | Jones |
| 5,382,025 | A | 1/1995 | Sklansky et al. |
| 5,395,120 | A | 3/1995 | Malek |
| 5,397,128 | A | 3/1995 | Hesse et al. |
| 5,407,199 | A | 4/1995 | Gumina |
| 5,417,430 | A | 5/1995 | Breeding |
| 5,431,408 | A | 7/1995 | Adams |
| 5,437,462 | A | 8/1995 | Breeding |
| 5,454,570 | A | 10/1995 | Karal |
| 5,470,080 | A | 11/1995 | Naka et al. |
| 5,489,101 | A | 2/1996 | Moody |
| 5,494,295 | A | 2/1996 | Potter et al. |
| 5,494,296 | A | 2/1996 | Grassa |
| 5,505,449 | A | 4/1996 | Eberhardt et al. |
| 5,531,448 | A | 7/1996 | Moody |
| 5,538,252 | A | 7/1996 | Green |
| 5,544,892 | A | 8/1996 | Breeding |
| 5,577,731 | A | 11/1996 | Jones |
| 5,580,061 | A | 12/1996 | Kong |
| 5,584,486 | A | 12/1996 | Franklin |
| 5,586,766 | A | 12/1996 | Forte et al. |
| 5,586,936 | A | 12/1996 | Bennett et al. |
| 5,597,162 | A | 1/1997 | Franklin |
| 5,630,757 | A | 5/1997 | Gagin et al. |
| 5,632,485 | A | 5/1997 | Woodland et al. |
| 5,636,842 | A | 6/1997 | Cabot et al. |
| 5,636,843 | A | 6/1997 | Roberts |
| 5,639,092 | A | 6/1997 | Macaisa |
| 5,653,444 | A | 8/1997 | Dahl |
| 5,660,393 | A | 8/1997 | Dreger |
| 5,673,917 | A | 10/1997 | Vancura |
| 5,678,821 | A | 10/1997 | Hedman |
| 5,685,774 | A | 11/1997 | Webb |
| 5,688,174 | A | 11/1997 | Kennedy |
| 5,695,189 | A | 12/1997 | Breeding et al. |
| 5,697,614 | A | 12/1997 | Potter et al. |
| 5,718,430 | A | 2/1998 | Aramapakul et al. |
| 5,725,216 | A | 3/1998 | Jones |
| 5,732,950 | A | 3/1998 | Moody |
| 5,743,532 | A | 4/1998 | Lafferty |
| 5,762,340 | A | 6/1998 | Feola |
| 5,781,647 | A | 7/1998 | Fishbine et al. |
| 5,794,934 | A | 8/1998 | Malcolm |
| 5,799,945 | A | 9/1998 | Boylan et al. |
| 5,816,575 | A | 10/1998 | Keller |
| 5,820,460 | A | 10/1998 | Fulton |
| 5,829,750 | A | 11/1998 | Booker |
| 5,839,730 | A | 11/1998 | Pike |
| 5,839,732 | A | 11/1998 | Guidi |
| 5,848,790 | A | 12/1998 | Huynh |
| 5,851,011 | A | 12/1998 | Lott |
| 5,863,041 | A | 1/1999 | Boylan et al. |
| 5,868,392 | A | 2/1999 | Kraft |
| 5,868,618 | A | 2/1999 | Netley et al. |
| 5,879,235 | A | 3/1999 | Kaneko et al. |
| 5,897,436 | A | 4/1999 | Singer et al. |
| 5,901,958 | A | 5/1999 | Andrews |
| 5,931,472 | A | 8/1999 | Ko |
| 5,934,675 | A | 8/1999 | Handelman et al. |
| 5,934,998 | A | 8/1999 | Forte et al. |
| 5,975,529 | A | 11/1999 | de Keller |
| 5,976,019 | A | 11/1999 | Ikeda et al. |
| 5,979,897 | A | 11/1999 | Grossman |
| 5,988,643 | A | 11/1999 | Awada |
| 6,000,699 | A | 12/1999 | Long |
| 6,007,424 | A | 12/1999 | Evers et al. |
| 6,012,719 | A | 1/2000 | Webb |
| 6,012,720 | A | 1/2000 | Webb |
| 6,019,374 | A | 2/2000 | Breeding |
| 6,027,119 | A | 2/2000 | De Lisle |
| 6,056,641 | A | 5/2000 | Webb |
| 6,068,258 | A | 5/2000 | Breeding et al. |
| 6,070,873 | A | 6/2000 | Perkins |
| 6,070,876 | A | 6/2000 | Ko |
| 6,095,525 | A | 8/2000 | Terminel |
| 6,113,102 | A | 9/2000 | Marks et al. |
| 6,113,103 | A | 9/2000 | Mostashari |
| 6,131,908 | A | 10/2000 | Palmer |
| 6,139,014 | A | 10/2000 | Breeding et al. |
| 6,146,270 | A | 11/2000 | Huard et al. |
| 6,149,154 | A | 11/2000 | Grauzer et al. |
| 6,158,741 | A | 12/2000 | Koelling |
| 6,165,069 | A | 12/2000 | Sines et al. |
| 6,170,827 | B1 | 1/2001 | Lombardo et al. |
| 6,179,290 | B1 | 1/2001 | Maahs |
| 6,179,910 | B1 | 1/2001 | Yokoyama et al. |
| 6,182,969 | B1 | 2/2001 | Green |
| 6,206,373 | B1 | 3/2001 | Garrod |
| 6,206,375 | B1 | 3/2001 | Wichinsky |
| 6,227,969 | B1 | 5/2001 | Yoseloff |
| 6,229,534 | B1 | 5/2001 | Gerra et al. |
| 6,237,916 | B1 | 5/2001 | Webb |
| 6,254,096 | B1 | 7/2001 | Grauzer et al. |
| 6,267,671 | B1 | 7/2001 | Hogan |
| 6,270,078 | B1 | 8/2001 | Leone et al. |
| 6,270,404 | B2 | 8/2001 | Sines et al. |
| 6,270,405 | B1 | 8/2001 | Ferguson |
| 6,273,424 | B1 | 8/2001 | Breeding |
| 6,279,910 | B1 | 8/2001 | de Keller |
| 6,293,551 | B1 | 9/2001 | Webb |
| 6,296,251 | B1 | 10/2001 | Webb |
| 6,299,534 | B1 | 10/2001 | Breeding et al. |
| 6,313,871 | B1 | 11/2001 | Schubert |
| 6,322,075 | B1 | 11/2001 | DeFranco |
| 6,325,373 | B1 | 12/2001 | Breeding et al. |
| 6,334,614 | B1 | 1/2002 | Breeding |
| 6,341,778 | B1 | 1/2002 | Lee |
| 6,345,823 | B1 | 2/2002 | Webb |
| 6,345,824 | B1 | 2/2002 | Selitzky |
| 6,371,867 | B1 | 4/2002 | Webb |
| 6,386,973 | B1 | 5/2002 | Yoseloff |
| 6,390,474 | B1 | 5/2002 | Terminel et al. |
| 6,394,456 | B1 | 5/2002 | Long |
| 6,394,898 | B1 | 5/2002 | Nagao et al. |
| 6,416,407 | B1 | 7/2002 | Carrico et al. |
| 6,422,564 | B1 | 7/2002 | Baranauskas |
| 6,446,972 | B1 | 9/2002 | Brunelle |
| 6,450,500 | B1 | 9/2002 | Miller |
| 6,454,266 | B1 | 9/2002 | Breeding et al. |
| 6,460,848 | B1 | 10/2002 | Soltys et al. |
| 6,469,747 | B1 | 10/2002 | Rai et al. |
| 6,481,718 | B2 | 11/2002 | Koelling |
| 6,481,719 | B2 | 11/2002 | Webb |
| 6,491,302 | B1 | 12/2002 | Boylan et al. |
| 6,503,145 | B1 | 1/2003 | Webb |
| 6,517,435 | B2 | 2/2003 | Soltys et al. |
| 6,517,436 | B2 | 2/2003 | Soltys et al. |
| 6,520,857 | B2 | 2/2003 | Soltys et al. |
| 6,523,829 | B1 | 2/2003 | Walker et al. |
| 6,523,831 | B2 | 2/2003 | Webb |
| 6,527,271 | B2 | 3/2003 | Soltys et al. |
| 6,530,836 | B2 | 3/2003 | Soltys et al. |
| 6,530,837 | B2 | 3/2003 | Soltys et al. |
| 6,533,276 | B2 | 3/2003 | Soltys et al. |
| 6,533,662 | B2 | 3/2003 | Soltys et al. |
| 6,540,230 | B1 | 4/2003 | Walker et al. |
| 6,561,897 | B1 | 5/2003 | Bourbour et al. |
| 6,568,678 | B2 | 5/2003 | Breeding et al. |
| 6,568,682 | B1 | 5/2003 | Hogan et al. |
| 6,579,180 | B2 | 6/2003 | Soltys et al. |
| 6,579,181 | B2 | 6/2003 | Soltys et al. |
| 6,588,751 | B1 | 7/2003 | Grauzer et al. |
| 6,595,857 | B2 | 7/2003 | Soltys et al. |
| 6,607,443 | B1 | 8/2003 | Miyamoto et al. |
| 6,609,711 | B1 | 8/2003 | Campbell |
| 6,626,433 | B2 | 9/2003 | Scibetta |
| 6,638,161 | B2 | 10/2003 | Soltys et al. |
| 6,651,981 | B2 | 11/2003 | Grauzer et al. |

6,651,982 B2 11/2003 Grauzer et al.
6,651,985 B2 11/2003 Sines et al.
6,652,379 B2 11/2003 Soltys et al.
6,655,684 B2 12/2003 Grauzer et al.
6,661,425 B1 12/2003 Hiroaki
6,663,490 B2 12/2003 Soltys et al.
6,698,758 B2 3/2004 Hodge
6,698,759 B2 3/2004 Webb et al.
6,702,289 B1 3/2004 Feola
6,719,291 B1 4/2004 deKeller
6,729,620 B2 5/2004 Jones
6,752,394 B2 6/2004 Malcolm
6,776,415 B2 8/2004 Robinson et al.
6,789,800 B2 9/2004 Webb
6,789,801 B2 9/2004 Snow
6,793,220 B1 9/2004 Feola
6,802,510 B1 10/2004 Haber
6,805,353 B2 10/2004 Williams
6,808,173 B2 10/2004 Snow
6,854,733 B2 2/2005 Webb
6,896,265 B1 5/2005 Schlumbrecht
6,902,167 B2 6/2005 Webb
7,036,818 B2 5/2006 Grauzer et al.
7,048,629 B2 5/2006 Sines et al.
7,118,112 B2 10/2006 Kenny et al.
7,165,770 B2 1/2007 Snow
7,175,180 B2 2/2007 Webb
7,195,243 B2 3/2007 Kenny et al.
7,238,108 B2 7/2007 Webb
7,246,799 B2 7/2007 Snow
7,255,351 B2 8/2007 Yoseloff et al.
7,264,243 B2 9/2007 Yoseloff et al.
7,309,065 B2 12/2007 Yoseloff et al.
7,331,579 B2 2/2008 Snow
7,367,563 B2 5/2008 Yoseloff et al.
7,367,884 B2 5/2008 Breeding et al.
7,384,044 B2 6/2008 Grauzer et al.
7,387,300 B2 6/2008 Snow
7,523,935 B2 4/2009 Grauzer et al.
7,575,237 B2 8/2009 Snow
7,584,966 B2 9/2009 Snow
7,628,689 B2 12/2009 Snow
7,661,676 B2 2/2010 Smith et al.
7,661,678 B2 2/2010 Snow
7,677,565 B2 3/2010 Grauzer et al.
7,753,373 B2 7/2010 Grauzer et al.
7,905,770 B2 3/2011 Snow
8,011,661 B2 9/2011 Stasson
8,038,521 B2 10/2011 Grauzer et al.
2001/0048197 A1 12/2001 Lo
2002/0103018 A1 8/2002 Rommerdahl et al.
2002/0169013 A1 11/2002 Serizawa et al.
2002/0175468 A1 11/2002 Kenny et al.
2002/0195773 A1 12/2002 Dunn
2002/0195775 A1 12/2002 Webb et al.
2003/0075869 A1 4/2003 Breeding et al.
2003/0155713 A1 8/2003 Jones et al.
2003/0199316 A1 10/2003 Miyamoto et al.
2004/0063482 A1 4/2004 Toyoda
2004/0150163 A1 8/2004 Kenny et al.
2004/0160006 A1 8/2004 Kenny et al.
2004/0224777 A1 11/2004 Smith et al.
2005/0029742 A1 2/2005 Snow
2005/0029744 A1 2/2005 Yoseloff et al.
2005/0104293 A1 5/2005 Webb
2005/0107148 A1 5/2005 Webb
2005/0164759 A1 7/2005 Smith et al.
2005/0164762 A1 7/2005 Smith et al.
2005/0170875 A1 8/2005 Snow
2005/0242506 A1 11/2005 Yoseloff
2005/0269783 A1 12/2005 Snow
2006/0014577 A1 1/2006 Snow
2006/0084505 A1 4/2006 Yoseloff et al.
2006/0084506 A1 4/2006 Yoseloff et al.
2006/0119044 A1 6/2006 Kekempanos et al.
2006/0186599 A1 8/2006 Kenny et al.
2006/0226605 A1 10/2006 Kenny
2006/0267285 A1 11/2006 Webb et al.
2006/0284376 A1 12/2006 Snow
2006/0284378 A1 12/2006 Snow et al.
2006/0290059 A1 12/2006 Scott et al.
2007/0024005 A1 2/2007 Snow
2007/0054733 A1 3/2007 Baerlocher
2007/0063442 A1 3/2007 Kenny et al.
2007/0080497 A1 4/2007 Kenny et al.
2007/0099686 A1 5/2007 Webb
2007/0111786 A1 5/2007 Snow
2007/0155462 A1 7/2007 O'Halloran et al.
2007/0210520 A1 9/2007 Webb
2007/0298854 A1 12/2007 Yoseloff et al.
2008/0007003 A1 1/2008 Davis et al.
2008/0042354 A1 2/2008 Yoseloff et al.
2008/0042355 A1 2/2008 Snow
2008/0070674 A1* 3/2008 Lancaster et al. ..... 463/22
2008/0096659 A1 4/2008 Kreloff et al.
2008/0207295 A1 8/2008 Yoseloff et al.
2008/0268933 A1* 10/2008 Sines et al. ..... 463/13
2008/0268940 A1* 10/2008 Sines et al. ..... 463/20
2009/0005144 A1 1/2009 Moody
2009/0075724 A1 3/2009 Breeding et al.
2009/0085296 A1 4/2009 Webb
2009/0227364 A1 9/2009 Kelly et al.
2009/0295091 A1 12/2009 Abbott et al.
2009/0315264 A1 12/2009 Snow et al.
2010/0225056 A1 9/2010 Grauzer et al.
2010/0276880 A1 11/2010 Grauzer et al.
2011/0165928 A1* 7/2011 Snow ..... 463/13
2011/0285081 A1 11/2011 Stasson
2011/0304098 A1 12/2011 Grauzer et al.
2012/0091657 A1 4/2012 Grauzer et al.
2012/0208615 A1* 8/2012 Lancaster et al. ..... 463/12
2012/0238338 A1* 9/2012 Kuhn et al. ..... 463/11

* cited by examiner

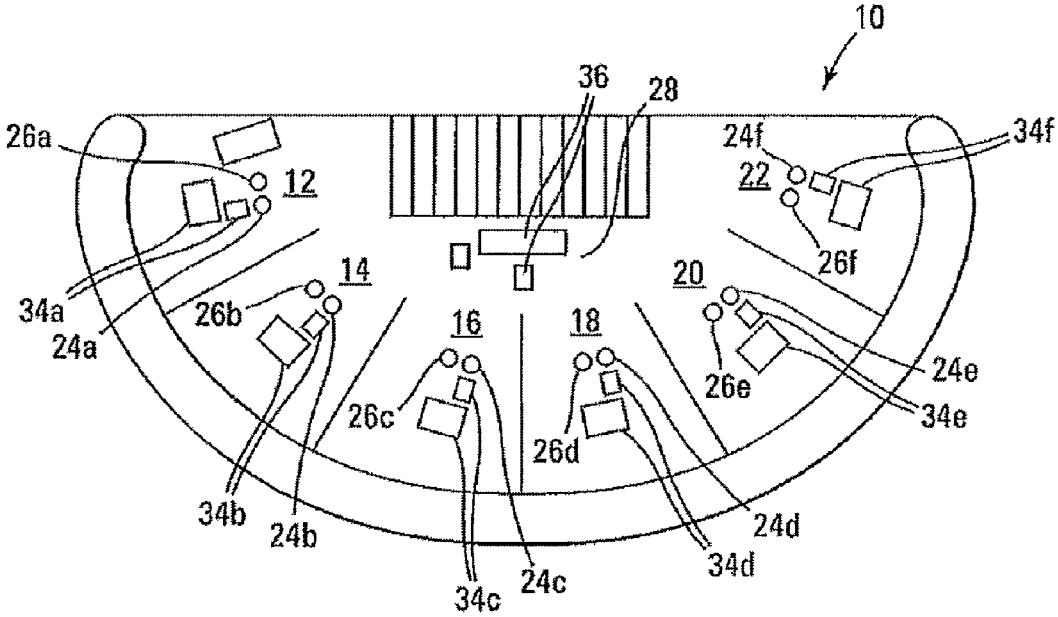
10
36
28
26a
12
24f
22
34f
26f
34a
24a
26b
14
20
16
18
24e
26e
34e
26c
26d
34b
24b
24d
34d
34c
24c

SPECIAL MULTIPLIER BONUS GAME IN PAI GOW POKER VARIANT

CROSS-REFERENCE TO RELATED APPLICATION

This application is a continuation of U.S. patent application Ser. No. 10/770,613, filed Feb. 2, 2004, now U.S. Pat. No. 7,905,770, issued Mar. 15, 2011.

TECHNICAL FIELD

The present invention relates to games of chance, particularly to card games of chance, and more particularly to bonus games in casino table card games. The invention has a highly desirable embodiment for use with the game of Pai Gow poker. The present invention is directed toward a variant of the game of Pai Gow poker and, more particularly, toward a method of playing an improved version of the game of Pai Gow poker that is intended to make the game more interesting and to increase revenues for casinos. The game also includes a bonus event with a side wager.

BACKGROUND

Although the game of Pai Gow poker, frequently referred to as Asian Poker and double hand poker, has been around for many years, it has not received widespread play in gambling establishments throughout the United States. As is well known in the art, the game is played with either tiles or with a standard deck of fifty-two playing cards with one joker added. In some versions of the game, a joker is utilized to represent only a limited number of cards such as an ace or as part of a straight or flush. Rankings in Pai Gow poker are substantially the same as rankings in other types of poker games.

Pai Gow poker is typically played in a casino at a table much like that used for Blackjack, casino table poker variants, Baccarat, or the like, except that there is typically one fewer player position. That is, there is a dealer position and six player positions equally spaced around a perimeter of the table. The game is limited to six player hands and a dealer hand, using forty-nine cards, leaving four remaining cards. At each player position, there are normally markings or indicia for setting the dealer's and players' high and low hands (explained hereinafter) and a spot for each player to place his or her ante or bet wager.

The game is typically started by each player placing a bet. The dealer then deals seven cards to himself or herself and seven cards to each of the six player positions, using forty-nine of the fifty-three cards in the playing card deck. Each player, including the dealer, then forms two hands from the holdings of seven cards. One hand, referred to as the "low hand," consists of two of the dealt cards. The other hand, referred to as the "high hand," consists of the remaining five cards that were dealt to that player. The high hand must be higher in poker rank than the low hand. If the hand is a Pai Gow (no ranked hands possible higher than an ace high), then the highest ranked card must be present in the high hand.

The only requirement in forming or setting the high and low hands is that the low hand must be of a lower rank than the high hand. The ranking of the hands is similar to traditional poker with the exception, as pointed out above, that the joker can be used to represent an ace or to represent any one card of either a straight or a flush. Thus, the highest possible hand is five aces.

If the player's low hand and high hand are both higher in rank than the low and high hand of the dealer or banker, the player is a winner and the banker loses. However, if both of the dealer's or banker's hands are higher than the player's, the player is a loser and the banker wins. If only one of either of the player's high or low hands tie or lose to the comparable dealer's hand, the round is considered a push. Under some house rules, the banker's hand is normally considered to be the winner in the event of a tie in both hands, or even one hand, although this latter rule is rarely used in play.

If the player's low hand is of a higher rank than the banker's low hand but the player's high hand is of a lower rank than the banker's high hand, neither wins and the round is considered to be a push. Similarly, a push exists when a player's low hand is of a lower rank than the banker's low hand and the player's high hand is of a higher rank than the banker's high hand. There is, therefore, no winner when a push exists.

In some casinos, the banker and the dealer are one and the same person employed by the casino. The dealer is employed by the casino and deals the cards but is also a player. More frequently, however, the players are given an option, in turn, to be the banker while each of the other players plays against the banker/player. (The banker is the dealer or player who is responsible for paying or collecting from each of the players.) When this is done, the house, that is, the establishment operating the game, takes a commission by way of a percentage on all winning wagers or is paid a flat commission per round or per hour.

The house also takes a commission or ante from each player when he or she wins. The commission may be about 1% of the wager, such as taking $0.25 from a $25.00 wager, $0.50 from a $25.00 to $50.00 wager, and $0.75 from a $51.00 to $75.00 wager. There are numerous ways in which the house can collect on a player-banked game.

There are a few known special bonuses that can be won at Pai Gow poker. In some locations, there may be bonuses for specially ranked hands, such as a pair of aces and a four-of-a-kind or higher, and a special bonus or jackpot for a pair of aces as the low hand and a straight flush or royal flush for the high hand.

U.S. Pat. No. 6,491,302 to Boylan et al. describes a method of playing a Pai Gow poker game in which, in addition to the usual seven cards dealt to each player and the dealer, a single player tiebreaker card is dealt for all players and a single dealer tiebreaker card is dealt to the dealer. The ante bet of each player is then paid off for winning and losing hands in the usual manner of a Pai Gow game. However, with push hands (where only one of the two-card hand and five-card hand of the player has a higher poker rank than the respective two-card hand and five-card hand of the dealer), the winner is determined by the higher value of the player and dealer tiebreaker cards so that no push bets occur.

U.S. Pat. No. 5,931,472 to Ko describes an improved game of Pai Gow, as set forth, which includes offering the player an optional bonus wager. Should the tiles of the player's hand match any predetermined bonus outcome tile combination, the player receives a reward for his or her bonus wager regardless of whether or not the player has won his or her hand according to the rules of Pai Gow.

U.S. Pat. No. 6,007,424 to Evers et al. describes a method, device, and system for playing a new game of Pai Gow poker. The method includes dealing seven cards to the dealer and to each player, the players and dealer each, from the seven cards dealt, assembling a five-card high hand and a two-card low hand. For the player to win his or her wager, both the player's high and low hands must outrank the dealer's hands according to the ranking of hands of poker. For a push the player's high hand must have a higher ranking the dealer's and must have a ranking of a pair of jacks or better. All other hands are losses. The method of the abovementioned U.S. Pat. No. 6,007,424 provides for greater payoffs if the player has one of a plurality of payoff qualifying holdings. The device includes a processor programmed to play the game according to the method. The system provides for linking devices to amass a progressive jackpot payout should a player obtain a qualifying hand.

U.S. Pat. No. 6,070,876 to Ko describes an improved game of Pai Gow that includes offering the player an optional bonus wager. Should the tiles of the player's hand match any predetermined bonus outcome tile combination, the player receives a reward for his or her bonus wager regardless of whether or not the player has won his or her hand according to the rules of Pai Gow. The game also provides an option to make a tie wager.

U.S. Pat. No. 6,113,103 to Mostashari teaches a variation of Pai Gow poker known as "Dragon" poker. A player posts a wager and is dealt a first four of seven cards face down. A bank is dealt a first four of seven cards, three of which are dealt face up. The player is then given an option of surrendering and receiving a return of a portion of the wager. With the surrender, the player's participation in the game is at an end. A player who does not surrender is a "surviving" player who may be given an option of increasing the wager. The surviving player and the bank are each dealt three additional cards to enable formation of a player back hand and a player front hand and formation of a bank back hand and a bank front hand. After the hands are formed, the wager is resolved.

U.S. Pat. No. 5,863,041 to Boylan et al. describes a method of playing a Pai Gow poker wagering game in which an ante bet is initially wagered and a bonus bet is also wagered by at least one player. Seven cards are then dealt to each player and the dealer and are arranged into a two-card low hand and a five-card high hand. The ante bet of each player is then paid off to in the usual manner for Pai Gow poker. Thereafter, a best five-out-of-seven-card poker hand is arranged by the dealer for each player from the seven cards initially dealt to the player, and the bonus bet is paid off if the best poker hand has a poker rank equal to or better than a first predetermined rank (e.g., a straight) but less than a second predetermined rank (e.g., a royal flush or five-of-a-kind in a wild card game). Next, the dealer determines whether the best poker hand of each player has a poker rank better than or equal to the second predetermined rank so that an auxiliary game of chance, such as rolling three dice, is then played to determine whether the bonus bet is paid off at a first payoff rate, when the player is a loser, or at a second payoff higher than the first payoff rate, when the player is a winner, in an auxiliary game. In addition, the dealer then determines whether each player has made a bonus bet of a predetermined minimum (exceeding the betting minimum), which is then paid off if any other player has a best poker hand equal to or better than a third predetermined rank (four-of-a-kind) in an event called an "envy" bet.

U.S. Pat. No. 6,270,078 to Leone et al. describes a version of the game of Pai Gow poker that allows a player to bet against the house and/or to bet against the other players. In addition to the conventional betting spot for placing an optional bet against the banker and/or other players, an additional betting spot is located in front of each of the players that allows the player to optionally bet against the house. This can be done whether or not the house is the banker. Thus, even if a fellow player has been designated as the banker, each other player can still choose to play against only the house. Each player can, of course, play against his or her fellow player/banker but is not required to do so. Each player can play against the house, against his or her fellow player/banker, against neither, or against both.

U.S. Pat. No. 5,584,486 to Franklin describes a method of playing a game of Pai Gow poker comprising: a player placing a first wager; a player placing a jackpot bet; and a dealer dealing seven cards to himself or herself and to the player. Each player arranges his or her cards into a low hand, including two of the seven cards, and a high hand, including five of the seven cards. Each player evaluates the cards and determines whether the cards comprise a predetermined jackpot card holding of a low hand pair and a high hand of one of (i) four aces and the joker, (ii) a royal flush, (iii) a straight flush, (iv) a four-of-a-kind, (v) a full house, (vi) a flush, or (vii) a straight. Players are paid a jackpot amount if the player has a jackpot holding. The winner of the first wager is determined by comparing a low hand of the dealer to the low hand of the player and a high hand of the dealer to the high hand of the player.

U.S. Pat. No. 5,580,061 to Kong describes a method of eliminating a push in a game of Pai Gow poker wherein a player and a banker are each dealt seven cards from a standard deck of fifty-two playing cards plus a joker, wherein the player and the banker each form a high hand and a low hand from the dealt cards. The method describes the steps of assigning a numerical value to each card; comparing a card in a player's hand to a corresponding card in a banker's hand; and designating a winner based upon whether or not the corresponding cards have total numerical values that are either both odd or both even.

U.S. Pat. No. 6,422,564 to Baranauskas describes a two-card poker game against a dealer in which a two-card dealer hand used in play is created from discarded cards from player hands. Players are initially dealt five cards each and are required to discard the highest card. The pool of discarded high cards is used to form the dealer's two-card poker hand. The game is played with a lower numerical ranking portion of a deck comprising the card ranks of two through eight of a typical fifty-two card poker deck. The game method includes the steps of each player placing an initial wager to participate in the game. If player positions are not occupied, the dealer retrieves the highest numerical ranking card from hands dealt to unoccupied positions and places those cards into the designated high card area in front of that unoccupied player position. Next, players decide which two cards of their remaining four cards they wish to hold and use to build their mandatory two-card hand. Players must place the two cards into an appropriate, depicted hold card area in front of that player position. Players must then discard the remaining two cards into an appropriate, depicted discard area in front of that player position. Each player then has the benefit of a two-card hand. The dealer chooses the house's two-card hand from the pool of high cards discarded by the players and placed in the designated area. The dealer indicates the choices by placing an indicator apparatus onto each of the two cards chosen. The dealer then informs the players of the house's two-card hand. Finally, all cards in each occupied player positions are shown, and the payouts to the winning hands and the collections of the losing hands wagers are resolved. The players play against the dealer and not against each other.

U.S. Pat. Nos. 6,481,719 to Webb and 6,012,719 also to Webb describe a card game that combines the play of blackjack ("21") with a three-card poker wager or side bet ("21+3"). Each player places a basic blackjack wager and an optional three-card poker wager before the cards are dealt. Each player is then dealt a card with the dealer receiving a face-up card. Each player is then dealt a second card. At this point, the outcome of each three-card poker hand is determined, wherein a three-card poker hand consists of the two-card hand dealt to that player and the dealer's face-up card. After settling the poker wagers, the game of blackjack continues in a typical fashion. The inventions advantageously retain all the features and advantages of blackjack as well as provide an additional opportunity to wager on a hand of three-card poker, without interfering with the card dealing sequence, for enhanced player anticipation and enjoyment.

Another known modification of the Pai Gow poker game has been played at "Harvey's Resort and Casino" in Stateline, Nev., near Lake Tahoe. In this modified game, a bonus bet is made (in addition to the ante bet in the usual game for the five-card hand and two-card hand ranks to be compared with those of the dealer). This bonus bet is won at odds if the player has any five cards (best five-card poker hand of the seven cards dealt), which together rank above a straight (with the odds increasing for increasingly ranked hands). In addition, if a player makes a bonus bet above $5 (5× the minimum), that player can additionally win a predetermined payoff if any other player has any best five-card hand that forms a poker rank above four-of-a-kind (with the payoff increasing for increasingly ranked hands). This type of payout is referred to in the industry as an "envy bonus." Envy bonuses are typically won on another player's hand, not on one's own hand.

Although Pai Gow poker has achieved a level of success such that it is present in most card rooms, it is desirable to provide additional features to the game that can make it even more attractive and successful.

SUMMARY

A side bet and corresponding bonus event are combined with the traditional game of Pai Gow poker. The bonus event does not in any way alter the strategy of play of the game. The bonus event requires no additional cards and adds interest to the game. Each player may make a first side-bet wager to enter the bonus game and may place a second side-bet wager or a larger first side-bet wager to enter an "envy hand" game event. The bonus game may be played and resolved before play of the Pai Gow game or after play of the Pai Gow game, but play and resolution of the bonus game is preferably done after the play of the underlying Pai Gow game. The first side-bet wager is made against a pay table, rather then against direct competitive rank play against other players and/or the house. The first side-bet wager is made on whether the player's hand will exceed a minimum rank and will be paid according to the relative level of the rank achieved in a five-card, best-of-seven-cards poker hand. The players place the bonus bet or side bet in a designated area. After the basic game of Pai Gow is resolved, the dealer forms a best-of-seven-cards five-card hand for each player, and payouts are made on the basis of those five-card hands having at least a minimum poker rank. After the five-card ranks are identified (and possibly after each player has been paid), the dealer's hand is reviewed with respect to the highest possible five-card hand in the dealer's seven cards. If the dealer's best-of-seven five-card hand rank is less than a predetermined rank, e.g., an ace-high Pai Gow (no hand of at least a rank of a pair), players having made the first side-bet wager will have any bonus payout for a ranked hand multiplied or otherwise increased. If a second side-bet wager or if a required minimum threshold amount for the first side-bet wager has been made, then an envy wager event will be played. In an envy wager event, for players making the qualifying envy bet wager, the appearance in any player's hand of a five-card hand of at least a second predetermined rank will provide a basis for a special bonus to the envy bet players, except for the player who obtained the five-card hand of the at least second predetermined rank.

BRIEF DESCRIPTION OF THE DRAWING

FIG. 1 is a top plan view of a playing surface of an example of game play of the present invention.

DETAILED DESCRIPTION

Among some of the features that can contribute to the unique play of the game of the present invention include one or more of at least the following elements:

1) The underlying game is a table version of a Pai Gow poker game.
2) A mandatory ante wager is placed to play in an underlying Pai Gow poker game against the dealer's hands.
3) An optional or mandatory side bet is placed at any time prior to the players viewing one or more cards to engage in a separately paying, side-bet wagering game against a pay table. The game is usually played with a standard deck without any jokers or with a fifty-three card standard playing card deck that includes a single joker, as in a conventional Pai Gow game. Winnings are determined in the separate, side-bet wagering game by resolution of best-of-seven five-card poker hands of each player making the first side-bet wager against a five-card poker ranking of hands in a pay table.
4) The separately paying, side-bet wagering game does not interfere with any underlying strategy in the play of the underlying Pai Gow game.
5) Before, after, or during play of the game against the pay table, a best-of-seven five-card hand is established for the dealer.
6) The separate side-bet wagering game is preferably played out after resolution of the underlying Pai Gow poker game. When the dealer's best-of-seven five-card poker hand has a low rank beneath or at a predetermined threshold, awards provided by the pay table on the separate, side-bet wagering game are increased, as by additive amounts, preferably by a multiplier effect, or by a combination of the additive amount and/or the multiplier effect.

The Pai Gow game is played to its normal conclusion, the separate, side-bet wagering game having no possible influence on the Pai Gow game. The side-bet wagering game against the pay table is played out (including the dealer hand evaluation bonus event), and, when at least one player has made a qualifying or additional wager in an envy bet event, envy bet events are resolved.

The present game may be more generally described as follows. An underlying game of Pai Gow is played (with the side bets not being considered in this underlying game). That underlying game of Pai Gow is generally played in a manner similar to the following steps.

Ante wagers are made by each player in the underlying Pai Gow game, the wagers being between a group of respective players and against a dealer. The outcome of the game is determined by randomly ordered playing cards having various ranks and suits. Seven cards are dealt to each player and to the dealer. The seven cards dealt to each player are arranged or "set" by that player into a two-card low hand and a five-card high hand (and the player may, in some instances, actually seek advice from the dealer in arranging legally proper hands). The seven cards dealt to the dealer are set by the dealer into a two-card low hand and a five-card high hand, usually according to house rules as to how hands must be arranged.

The respective five-card hands and two-card hands of each player and the dealer are compared. The ante bet of each player is paid off according to the rules of play of Pai Gow poker. The payout is made to the respective player if both the two-card hand and the five-card hand of the player have a higher poker rank than the respective two-card hand and five-card hand of the dealer. The bet is taken by the house if both the two-card hand and the five-card hand of the player have a lower poker rank than the respective two-card hand and five-card hand of the dealer. Bets are a push when only one of the two-card hand and five-card hand of the player has a higher poker rank than the respective two-card hand and five-card hand of the dealer. This is the basic manner in which the underlying game of Pai Gow is played. Other considerations in this play include the fact that the house will require a payment from each player that wins in the underlying game with the house "take" typically based upon the size of the wager made by the player in the underlying game.

In the modified Pai Gow poker game of the present invention, there are additional, but simple steps that are or may be performed. At the beginning of the underlying Pai Gow poker game, the players have an optional or mandatory bonus game side-bet wager that is or may be made. The amount of the side-bet wager may be independent of the underlying wager in the Pai Gow poker game. For example, the side-bet wager may require a minimum of a $1.00 wager, whether in a $5.00, $10.00, or $25.00 minimum bet Pai Gow poker game. The amount of this minimum wager may be varied according to the design of the game, the target house hold, and variations in the game that may be made by the house.

Considering only the bonus pay table game at this time, the modified Pai Gow poker game of the invention could proceed as follows. After the play of the underlying Pai Gow poker game and the resolution of the game bets, the players (alone or with the assistance of the dealer) could then examine their seven cards and create a best five-card poker hand. This best five-card poker hand might actually be different from the five-card hand played during the Pai Gow poker game, because of strategy considerations. For example, it is a common strategy to split a full house in Pai Gow poker to form a three-of-a-kind high hand and a pair for the low hand to increase the likelihood of a win. If the best five-card hand exceeds a minimum rank (e.g., at least a straight), the player holding that five-card hand that at least exceeds the minimum rank is entitled to a bonus against a pay table. This bonus payout is in addition to the win in the underlying Pai Gow poker game. An example of a pay table for the bonus win on the side bet could be:

| BEST 5-CARD HAND | PAYOUT TIMES GAME WAGER |
|---|---|
| Royal Flush | 100:1 |
| Straight Flush | 25:1 |
| Four-of-a-Kind | 10:1 |
| Full House | 3:1 |
| Flush | 2:1 |
| Three of a Kind | 2:1 |
| Straight | 1:1 |

At this time (that is, after the players have organized their best five-card poker hands and compared them to the pay table) or earlier in the play of the game, but after resolution of the underlying Pai Gow poker wager, the dealer arranges the dealer's seven cards into a best five-card poker hand. Where the best five-card poker hand falls at or under a threshold of a rank hand, that is, has a rank equal to or less than a predetermined rank, a further bonus consideration is made in the separate, side-bet wagering game.

A "Pai Gow" hand for purposes of this disclosure is defined as a hand in which no pairs or higher can be made from all seven cards in the hand. If the threshold for this additional bonus consideration is set at the Pai Gow hand level (as opposed to a pair of deuces or lower, a pair of 3's or lower, a pair of 4's or lower, a king-high Pai Gow (i.e., there are no pairs or higher available and the highest card in the dealer's hand is a king, excluding an ace-high Pai Gow hand), a queen-high Pai Gow, a jack-high Pai Gow, or a 10-high Pai Gow hand, etc.), the dealer's hand is reviewed for its best five-card rank. If the dealer's hand falls below or meets this threshold, an enhanced or additional bonus is available to all players that have their own bonus hand. For example, if the threshold dealer's hand for the additional bonus is a king-high Pai Gow hand, has no flush, and consists of jack, 10, 9, 7, 5, 4, and 2, the threshold has been met and the player with a ranked bonus hand will have the bonus hand pay out increased. For further illustration, if the player had a high hand and low hand of a straight and a pair, respectively, and had made an initial $10.00 Pai Gow wager and a $1.00 side-bet wager, in this circumstance the player would be paid $10.00 (even money) less house commission (e.g., $0.50) on the Pai Gow poker game wager (assuming a win), would be entitled to $10.00 bonus for having the straight, and, because of the dealer's low threshold hand, the $10.00 bonus would be multiplied to $20.00 (assuming 2× for the additional bonus effect for the dealer having a low threshold hand). The player would therefore receive the initial $10.00 wager and a return of $30.00 on both games, while losing the $1.00 side-bet wager that is always collected by the house.

This play offers some significant benefits to the player and the house while increasing the potential for enjoyment by the players. First, there are no additional implements needed to add a bonus feature to Pai Gow poker, such as dice or a roulette-type wheel. The game does not allow for any change in strategy in the play of the underlying game. The bonus events may be quickly and easily determined.

Many variations are allowed within the play of the bonus event game. For example, the additional bonus for the dealer having a low threshold hand can be variable. For example, the multiplier can be 1× the player's bonus hand award for any Pai Gow hand (or other determined threshold) in addition to the payout for the bonus hand (e.g., the 1:1 shown above for a straight). The multiplier could be 1× for a queen-high, king-high, or ace-high Pai Gow dealer hand and 2× for a jack-high or lower Pai Gow dealer hand. The multiplier could be 1× for a king-high or ace-high Pai Gow dealer hand, 2× for a queen-high or a jack-high Pai Gow dealer hand, and 3× (or more) for a 10-high or lower or for a 9-high or lower Pai Gow dealer hand. A perfect Pai Gow low hand (9-8-7-5-4-3-2 or 9-8-7-6-4-3-2 out of suit) could pay 10×. It is also possible for absolute payout amounts to be made, rather than, or in addition to, multipliers of the bonus hand pay table awards. For example, on a $1.00 bonus side-bet wager, the player may be given $50.00 if the dealer has a 10-high Pai Gow hand or lower. This absolute payout amount may be given whether or not the player has a bonus ranked hand, but optionally does require the side-bet wager to be placed. As the size of the side-bet wager increases (in addition to potential effects on an envy wager, later discussed herein), it is also possible for the threshold level to change. The change may be for an individual player or for the table. For example, with a $1.00 side-bet wager, the threshold for the bonus may be a dealer's 10-high Pai Gow hand or lower. With a $2.00 wager, the threshold for the bonus may be a dealer's jack-high Pai Gow hand or lower. For a $3.00 side-bet wager, the threshold for the bonus may be a dealer's queen-high Pai Gow hand or lower. For a $5.00 wager, the threshold for the bonus may be a dealer's ace-high Pai Gow hand or lower, or even a pair of 2's or 3's or lower.

It is desirable that all bonus ranked hands (e.g., all hands of a straight or better, including a royal flush and five-of-a-kind in a wild card variation or in a variation using the joker as a fifth ace) be paid from the bonus pay table, although that is not required. The use of the additional bonus effect based upon the analysis of the dealer's best five-card hand and the low rank of the dealer's hand is, in itself, a unique attribute and adds significant interest to the play of the game. One of the clear benefits of this game is that players already root for the dealer to have a low rank hand, so that they can win the underlying Pai Gow game. Now there is greater incentive and greater value in finding low rank hands for the dealer. This keeps the objectives and interests of players focused on the same events and evaluations. In other embodiments, players are required to play the bonus with their existing five-card high hand or another combination of dealer and/or player cards.

Another optional, but preferred element of the game is the envy bet. This is similar to the envy event found in the play of prior art games such as the Pai Gow poker game played at "Harvey's Resort and Casino" in Stateline, Nev., near Lake Tahoe, and disclosed in U.S. Pat. No. 5,863,041, which are described in greater detail above. The envy poker game may be entered by a separate, side-bet wager (e.g., a second side-bet wager of, for example, $1.00, $2.00, $3.00, $4.00, or $5.00) or by having a larger first side-bet wager (e.g., at least $4.00, $5.00, more, or less). It is preferred to have the envy bet entered by a single wager combined with the first side-bet wager on the pay table bonus event. For example, a $1.00 side-bet wager may enter the player in only the pay table bonus event (with or without the dealer hand bonus); a $2.00 side-bet wager may enter the player in the pay table bonus and the dealer low hand bonus event; and a $5.00 wager may enter the player into the pay table event, the dealer low hand bonus event, and the envy poker game event. In one preferred form of the invention, only the pay table and dealer low hand bonus events are provided in the same game.

The envy event is resolved, for example, as follows. After all best five-card poker hands have been displayed for all of the players (not just the players making the qualifying envy bet), the hands are viewed to see whether any player has a hand rank that is sufficiently high enough to "trigger" the envy hand feature. If one or more players has a triggering hand, only the highest of the triggering hands is usually considered. For example, if an envy bet triggering hand is at least a full house, and one player has a full house and another player has a four-of-a-kind, the four-of-a-kind hand is preferably used for the envy hand event. For all players that have made the envy bet (except for the player who has the high envy hand qualifying or triggering hand), there is an additional bonus feature with those players being paid an additional bonus amount (based on their underlying game wager and/or on their envy hand event qualifying wager) in accordance with a separate pay table for envy hand events. For example, if a first player is the only player to make the qualifying envy event wager and that player has a losing Pai Gow hand and no bonus event best five-card hand, that player would be paid from a pay table if a second player at the table (who may or may not have made a qualifying envy bet wager) has an envy event triggering hand, such as a four-of-a-kind. It is therefore possible for a player to ride on the hands of other players' good cards, which is especially attractive if there are more players at a table, the probability of a triggering hand at the table increasing because of the larger number of player hands at the table. This envy hand game event may be described as determining whether each player has made a bonus bet of a predetermined minimum that thus qualifies as an envy bet; and paying off of any envy bet by each player if any other player has a best poker hand equal to or better than a triggering predetermined poker rank. Although, in a preferred form of the invention, only certain high ranking hands pay an envy bonus, the game could be structured so that all winning bonus hands also pay an envy bonus payout.

EXAMPLES

An example of a round of play of the Pai Gow poker game with side bet according to the invention is as follows. To simplify the description, only four players are at the table, Players 1, 2, 3, and 4. The table surface 10 is shown in FIG. 1. Players are located at player positions 12, 14, 16, and 18, although six player hands and a dealer hand are dealt, with four residual cards.

Players 1, 2, 3, and 4 place $5 wagers on betting circles 24*a*-24*d*, in the underlying Pai Gow game. Players 1 and 2 place wagers of $1, Player 3 places a wager of $5, and Player 4 places no wager, respectively, on areas 26*a*, 26*b*, 26*c*, and 26*d*, the side-bet game. Player positions 12, 14, 16, 18, 20, and 22, and the dealer's position 28 are dealt seven cards each from a starting deck of fifty-three cards, which includes a standard fifty-two card playing deck and a joker. Player hand positions 20 and 22 are each designated as a Dragon hand, which each player declines to buy. Each player and the dealer sets his or her high and low hands and places them in the appropriate hand areas 34*a*-34*f* and 36 (also referred to herein as central position 36).

The normal play of Pai Gow poker is undertaken, and the events of that play are immaterial to the play of the side-bet wager. The hands are left on the table. At the conclusion of the Pai Gow game, the dealer reviews or arranges the players' seven cards to identify a best five-card poker hand for each player. The dealer may also arrange the dealer cards into a best five-card hand at this time or may wait to arrange the dealer's hand. This is an insignificant choice because the dealer's hand is already fully exposed. The dealer examines the best five-card hands of all players to determine whether any player who entered into the side-bet wager game against the pay table has a qualifying hand, that is, a hand of at least a straight in the example of this game. The dealer's best five-card hand cards are displayed by the dealer at the central position 36 (e.g., where the dealer's hand had been previously located).

It is assumed in this example that the Pai Gow game has been resolved and the best five-card hands are, for Player 1, a three-of-a-kind; for Player 2, a straight; for Player 3, two pair; and for Player 4, a full house. In this situation, Player 1, who entered the side-bet pay table game, receives no bonus payment, the player's hand being below the threshold of a straight. Player 2 receives a guaranteed bonus payout of 1:1 on the original Pai Gow wager because of the straight. Player 3, who entered the side-bet pay table game, receives no bonus payment, the player's hand being below the threshold of a straight. Player 4 receives no bonus for the full house, because no side-bet wager against the pay table was made by Player 4.

However, Player 3 also made a qualifying wager for the envy hand bet, and because Player 4 had a triggering hand, Player 3 would be paid for the full house against a pay table set up for the envy wager. In this case, Player 3 would be paid 3× against his original wager because Player 4 had an envy triggering hand.

As stated previously, the winning envy bonus hands may be the same hands that pay a bonus, a subset of those hands, or even different hands.

The invention has been described in terms of specific examples to assist in understanding the practice of the invention, but alternative rules and materials can be used in the play of the game. For example, a smart automatic card shuffling system such as the MD2® Card Shuffler with card reading capability from Shuffle Master Inc., Las Vegas, Nev., could be used to provide batches of shuffled cards to the game. This device is disclosed in U.S. patent application Ser. No. 10/623,223, filed Jul. 17, 2003, now U.S. Pat. No. 7,677,565, issued Mar. 16, 2010, titled "Card Shuffler with Card Rank and Value Reading Capability," assigned to Shuffle Master, Inc. The disclosure of this patent application is incorporated herein by reference. This shuffler can be programmed to provide batches of cards as required for the play of Pai Gow poker. The shuffler is capable of reading the cards as they are being fed into the shuffler. A special display could be provided that would show the four cards in the residual hand that are fed into the shuffler. The cards could be displayed using the card revelation system of U.S. Pat. No. 6,386,973 to Yoseloff, or a traditional display panel showing the deal position of each hand as described in U.S. Pat. No. 5,275,411 to Breeding could be expanded to show the hand read from the residual cards and announce the amount of the bonus in alphanumerics.

Other options in the play of the game are also possible. For example, by requiring a mandatory envy qualifying wager or merely by having an envy qualifying wager, the normal house withholding in the underlying Pai Gow game can be eliminated for players making that wager, at least up to a maximum amount of the Pai Gow wager. The return for the side-bet wager could balance out that return to the house. As Pai Gow wagers tend to be more restricted in size, the maximum withdrawal by the house tends to be low, such as $0.50 to $5.00. By requiring a $5.00 mandatory wager for the pay table event and the envy hand event, the house withdrawal can be reduced or eliminated.

One aspect of a game according to the present invention may be described as a method of playing a Pai Gow poker wagering card game. This aspect of the method of play may comprise:

a) players wagering an ante bet on a Pai Gow game, as described above and as generally known in the art;
b) players placing a wager (which may be optional or mandatory) against a pay table on a separate poker-type game that uses a best five-card hand from each player's hand;
c) dealing seven-card hands from a set of cards to six player positions and one dealer position, as is done in the standard play of Pai Gow poker;
d) resolving the game of Pai Gow poker against the standard rules of Pai Gow poker as described above, wherein players' hands of two-card low hands and five-card high hands compete against a dealer's two-card low hand and the dealer's five-card high hand;
e) after resolution of the underlying Pai Gow poker game, forming best five-card poker hands for at least each player having placed the wager against the pay table (of winning card combinations and corresponding pay out odds), and alternatively for every player at the table, whether or not each player has placed the wager against the poker table;
f) resolving wagers with players who have placed the wager against the pay table, making an award to that player when that player's best five-card poker hand equals or exceeds a predetermined rank; and
g) providing an additional award to players who have placed the wager against the pay table i) when that player's best five-card poker hand equals or exceeds a predetermined rank and ii) when a best five-card hand for the dealer is equal to or less than a predetermined rank.

The method is preferably played with a set of cards comprising or consisting of a standard fifty-two card deck plus at least one joker. Entry into an envy hand poker game, as the game is known in the art and as described herein may be made in a number of ways. The envy hand poker game may be an automatic part of the Pai Gow game, without an additional wager; the envy hand poker game may be entered solely by making the wager against the pay table for the five-card poker game; or the envy hand poker game may require a separate qualifying wager specific for that game or an elevated (more expensive) wager against the pay table to enable entry into both the wager against the pay table and the envy hand poker game. For example, a wager against the pay table of $1.00 may enter the player against only the pay table, while a wager of $5.00 against the pay table may enter the player into both the wager against the pay table and the envy hand poker game. Thus, the wager against a pay table may or may not enter the player into an envy hand wagering event. Also, the first level of the wager against a pay table may enter the player into the wagering event against the pay table, and a second, higher level of wager against the pay table may also enter the player into the wagering event against the pay table and an envy hand poker gaming event. The wager against the pay table may be mandatory or optional. The pay table for the best five-card hand for a player may require a rank of at least a ranked two pair, at least a three-of-a-kind, at least a straight, or at least a flush for payment for a ranked hand in the table.

Another way of describing a variant Pai Gow poker game of the invention is as a method of playing a Pai Gow poker wagering card game comprising:

h) players wagering on a Pai Gow game;
i) players placing a wager (optional or mandatory) on a separate poker-type game that uses the best five-card hands from the player cards;
j) dealing seven-card hands to multiple player positions (e.g., usually six position, but fewer positions may be dealt to without altering the game) and one dealer position;
k) resolving the game of Pai Gow poker according to the standard rules of Pai Gow poker or any special house rules;
l) comparing each best five-card poker hand made from the seven player cards against a pay table for predetermined hand ranks;
m) paying players who have both placed the additional wager and displayed five-card poker hands of at least the predetermined rank according to the pay table and rules of the separate poker-type game played with best five-card hands of the players; and
n) if a best five-card hand for the dealer from the dealer's Pai Gow cards is equal to or less than a predetermined rank, increasing the amount of payment to players from step m, above.

As with the other description of a Pai Gow poker variant game according to the invention, an envy hand poker game may be included with similar steps and methods as described above. A jackpot event or progressive jackpot event may also be included by utilizing various methods in these games. A separate wager may be placed, a portion of the wager against the pay table may be added to the jackpot, or, alternatively, some or all of the house withdrawal from winning Pai Gow hands may be added to the jackpot. In this way, a fee may be charged by the dealer for a favorable resolution of the Pai Gow wager, when the wager against the pay table is made, and yet players will appreciate that a jackpot is accumulating at least in part from this fee.

All of the apparatus, devices, and methods disclosed and claimed herein can be made and executed without undue experimentation in light of the present disclosure. While the apparatus, devices, and methods of this invention have been described in terms of both generic descriptions and preferred embodiments, it will be apparent to those skilled in the art that variations may be applied to the apparatus, devices, and methods described herein without departing from the concept and scope of the invention. More specifically, it will be apparent that certain elements, components, steps, and sequences that are functionally related to the preferred embodiments may be substituted for the elements, components, steps, and sequences described and/or claimed herein while the same or similar results would be achieved. All such similar substitutions and modifications apparent to those skilled in the art are deemed to be within the scope and concept of the invention as defined by the appended claims.

What is claimed is:

1. A method of playing a Pai Gow poker wagering card game comprising:

a dealer accepting a wager from a player to initiate play of a Pai Gow game;

the dealer accepting another wager from the player to initiate play of a poker-type game utilizing a pay table;

the dealer dealing to each of a plurality of player positions and to a dealer position a seven-card hand formed from a set of playing cards to form at least one seven-card player hand at one of the plurality of player positions and to form a seven-card dealer hand at the dealer position;

the dealer resolving the Pai Gow game;

the dealer reviewing a best five-card player poker hand formed from the at least one seven-card player hand;

the dealer resolving the poker-type game utilizing the pay table, comprising:

the dealer determining whether the best five-card player poker hand meets or exceeds a predetermined rank; and if the dealer determined that the best five-card player poker hand meets or exceeds the predetermined rank, the dealer further resolving the poker-type game, comprising:

the dealer awarding to the player a payout based at least in part on the pay table, the wager, and the best five-card player poker hand;

the dealer reviewing a best five-card dealer poker hand formed from the seven-card dealer hand;

the dealer determining whether the best five-card dealer poker hand meets or falls below another predetermined rank; and if the dealer determined that the best five-card dealer poker hand meets or falls below the another predetermined rank, the dealer awarding to the player another payout; and if the dealer determined that the best five-card player poker hand does not meet or exceed the predetermined rank, the dealer retaining the another wager.

2. The method of claim 1, wherein the dealer dealing to each of a plurality of player positions and to a dealer position a seven-card hand comprises the dealer dealing to each of six player positions and to the dealer position the seven-card hand formed from a set of playing cards comprising a standard fifty-two card deck to form the at least one seven-card player hand at one of the six player positions and to form the seven-card dealer hand at the dealer position.

3. The method of claim 1, wherein the dealer dealing to each of a plurality of player positions and to a dealer position a seven-card hand comprises the dealer dealing to each of the plurality of player positions and to the dealer position the seven-card hand formed from a set of playing cards comprising a fifty-two card playing card deck and one joker to form the at least one seven-card player hand at one of the plurality of player positions and to form the seven-card dealer hand at the dealer position.

4. The method of claim 1, wherein the dealer accepting another wager from the player to initiate play of a poker-type game utilizing a pay table does not initiate play of an envy hand wagering event.

5. The method of claim 1, wherein the dealer accepting another wager from the player to initiate play of a poker-type game utilizing a pay table comprises the dealer accepting the another wager from the player to initiate play of the poker-type game utilizing the pay table and to initiate play of an envy hand wagering event.

6. The method of claim 5, wherein the dealer accepting the another wager from the player comprises the dealer accepting the another wager from the player to initiate play of the poker-type game utilizing the pay table and to initiate play of the envy hand wagering event, the another wager not being a prerequisite to play of the Pai Gow game.

7. The method of claim 1, wherein the dealer accepting another wager from the player comprises:

the dealer determining whether the another wager exceeds a predetermined value; and if the dealer determined that the another wager does not exceed the predetermined value, the dealer initiating play of the poker-type game utilizing the pay table; and if the dealer determined that the another wager exceeds the predetermined value, the dealer initiating play of the poker-type game utilizing the pay table and initiating play of an envy hand wagering event.

8. The method of claim 1, wherein the dealer accepting another wager from the player comprises the dealer accepting the another wager from the player to initiate play of a poker-type game utilizing a pay table, the another wager not being a prerequisite to play of the Pai Gow game.

9. The method of claim 1, wherein the dealer determining whether the best five-card player poker hand meets or exceeds a predetermined rank comprises the dealer determining whether the best five-card player poker hand meets or exceeds a predetermined rank of a three-of-a-kind.

10. The method of claim 1, wherein the dealer determining whether the best five-card player poker hand meets or exceeds a predetermined rank comprises the dealer determining whether the best five-card player poker hand meets or exceeds a predetermined rank of a straight.

11. The method of claim 1, wherein, if the dealer determined that the best five-card dealer poker hand meets or falls below the another predetermined rank, the dealer awarding to the player another payout comprises the dealer awarding to the player another payout of a multiple of the wager, the multiple being at least one.

12. The method of claim 11, wherein the dealer awarding to the player another payout of a multiple of the wager comprises the dealer awarding to the player another payout of a fixed multiple of the wager.

13. The method of claim 11, wherein the dealer awarding to the player another payout of a multiple of the wager comprises the dealer awarding to the player another payout of a multiple of the wager, the multiple depending on a composition of the best five-card dealer poker hand.

14. The method of claim 1, wherein, if the dealer determined that the best five-card dealer poker hand meets or falls below the another predetermined rank, the dealer awarding to the player another payout comprises the dealer awarding to the player another payout, a summation of the another payout and the payout equaling a multiple of the wager.

15. A method of playing a Pai Gow poker wagering card game comprising:

a dealer accepting a wager from a player to initiate play of a Pai Gow game;

the dealer accepting another wager from the player to initiate play of a separate five-card poker-type game, the another wager not being a prerequisite to play of the Pai Gow game;

the dealer dealing to each of six player positions and a dealer position a seven-card hand of playing cards to form at least one seven-card player hand at one of the six player positions and to form a seven-card dealer hand at the dealer position;

the dealer resolving the Pai Gow game;

the dealer resolving the separate five-card poker-type game, comprising:

the dealer comparing a best five-card player poker hand formed from the at least one seven-card player poker hand to a pay table to determine whether the best five-card player poker hand meets or exceeds a predetermined rank defined by the pay table; and if the dealer determined that the best five-card player poker hand meets or exceeds the predetermined rank, the dealer further resolving the separate five-card poker-type game, comprising:

the dealer determining a payout amount based at least in part on the pay table, the wager, and the best five-card player poker hand;

the dealer determining whether a best five-card dealer poker hand formed from the seven-card dealer hand meets or falls below another predetermined rank;

if the dealer determined that the best five-card dealer poker hand meets or falls below the another predetermined rank, the dealer increasing the payout amount to an increased payout amount and awarding to the player an increased payout of the increased payout amount; and if the dealer determined that the best five-card dealer poker hand does not meet or fall below the another predetermined rank, the dealer awarding to the player a payout of the payout amount; and if the dealer determined that the best five-card player poker hand does not meet or exceed the predetermined rank, the dealer retaining the another wager.

16. The method of claim 15, wherein the dealer dealing to each of six player positions and a dealer position a seven-card hand of playing cards comprises the dealer dealing to each of the six player positions and the dealer position the seven-card hand of playing cards from a set comprising a fifty-two card playing card deck and a joker to form the at least one seven-card player hand at one of the six player positions and to form the seven-card dealer hand at the dealer position.

17. The method of claim 15, wherein the dealer accepting another wager from the player to initiate play of a separate five-card poker-type game does not initiate play of an envy hand wagering event.

18. The method of claim 15, wherein the dealer accepting another wager from the player to initiate play of a separate five-card poker-type game comprises the dealer accepting the another wager from the player to initiate play of the separate five-card poker-type game and to initiate play of an envy hand wagering event.

19. The method of claim 15, wherein the dealer accepting another wager from the player comprises:

the dealer determining whether the another wager exceeds a predetermined value; and if the dealer determined that the another wager does not exceed the predetermined value, the dealer initiating play of the separate five-card poker-type game; and if the dealer determined that the another wager exceeds the predetermined value, the dealer initiating play of the separate five-card poker-type game and initiating play of an envy hand wagering event.

20. The method of claim 15, wherein the dealer comparing a best five-card player poker hand formed from the at least one seven-card player poker hand to a pay table comprises the dealer comparing the best five-card player poker hand formed from the at least one seven-card player poker hand to the pay table to determine whether the best five-card player poker hand meets or exceeds a predetermined rank of at least a three-of-a-kind defined by the pay table.

21. The method of claim 15, wherein the dealer comparing a best five-card player poker hand formed from the at least one seven-card player poker hand to a pay table comprises the dealer comparing the best five-card player poker hand formed from the at least one seven-card player poker hand to the pay table to determine whether the best five-card player poker hand meets or exceeds a predetermined rank of at least a straight defined by the pay table.

22. The method of claim 21, wherein the dealer accepting another wager from the player comprises the dealer accepting the another wager from the player to initiate play of the separate five-card poker-type game, the another wager not being a prerequisite to play of the Pai Gow game but qualifying the player for a potential Pai Gow win payout without the dealer deducting a fee from the potential Pai Gow win payout.

23. The method of claim 15 further comprising the dealer accepting an envy wager from the player to initiate play of an envy hand wagering event, the envy wager and the another wager together qualifying the player for a potential Pai Gow win payout without the dealer deducting a fee from the potential Pai Gow win payout.

24. The method of claim 15, wherein, if the dealer determined that the best five-card dealer poker hand meets or falls below the another predetermined rank, the dealer increasing the payout amount to an increased payout amount comprises the dealer increasing the payout amount to an increased payout amount equal to a multiple of the wager, the multiple being at least one.

25. The method of claim 24, wherein the dealer increasing the payout amount to an increased payout amount equal to a multiple of the wager comprises the dealer increasing the payout amount to an increased payout amount equal to a fixed multiple of the wager.

26. The method of claim 24, wherein the dealer increasing the payout amount to an increased payout amount equal to a multiple of the wager comprises the dealer increasing the payout amount to an increased payout amount equal to a multiple of the wager, the multiple depending on a composition of the best five-card dealer poker hand.

27. The method of claim 15, wherein, if the dealer determined that the best five-card dealer poker hand meets or falls below the another predetermined rank, the dealer increasing the payout amount to an increased payout amount comprises the dealer increasing the payout amount to the increased payout amount equaling a multiple of the wager.

* * * * *